US005205088A

United States Patent [19]

Mueller

[11] Patent Number: 5,205,088

[45] Date of Patent: Apr. 27, 1993

[54] ROOFING SNOW PANEL AND METHOD OF CONSTRUCTING SAME

[76] Inventor: George B. Mueller, 3540 Chalet, Crete, Ill. 60417

[21] Appl. No.: 839,387

[22] Filed: Feb. 21, 1992

[51] Int. Cl.[5] ..... E04D 13/10

[52] U.S. Cl. ..... 52/24; 52/630

[58] Field of Search ..... 52/23, 24, 84, 536, 52/537, 520, 478, 528, 630

[56] References Cited

U.S. PATENT DOCUMENTS

| | | | |
|---|---|---|---|
| 2,270,537 | 1/1942 | Ludington | 52/24 |
| 3,058,265 | 10/1962 | Lapsensohn | 52/24 |
| 3,583,113 | 6/1971 | Winski | 52/24 |
| 5,044,130 | 9/1991 | Chiddister | 52/24 |

FOREIGN PATENT DOCUMENTS

| | | | |
|---|---|---|---|
| 191597 | 9/1957 | Austria | 52/24 |
| 0095455 | 11/1983 | European Pat. Off. | 52/24 |
| 0273833 | 7/1988 | European Pat. Off. | 52/24 |
| 689314 | 3/1953 | United Kingdom | 52/478 |

*Primary Examiner*—David A. Scherbel

*Assistant Examiner*—Christopher T. Kent

*Attorney, Agent, or Firm*—Bernard L. Kleinke; Jerry R. Potts; William Patrick Waters

[57] ABSTRACT

A roofing panel construction with at least one upstanding projection which holds accumulating precipitation in the form of snow in stasis from movement. Each projection has a smoothly rounded contoured back body with a front wall having a generally flat front outer face to arrest or inhibit the downward motion of accumulated snow or ice. The body of each projection is generally triangularly shaped in cross section throughout its longitudinal dimension for strengthening the body and wall under snow or ice loading. The front wall of each projection is disposed at an acute angle relative to the transverse dimension of its associated panel for helping to prevent the accumulation of standing water as accumulated snow or ice melts gradually. Similar projections are staggered and angularly displaced relative to one another. In another form of the invention, different types of projections are spaced apart and aligned relative to one another.

17 Claims, 8 Drawing Sheets

Fig. 1
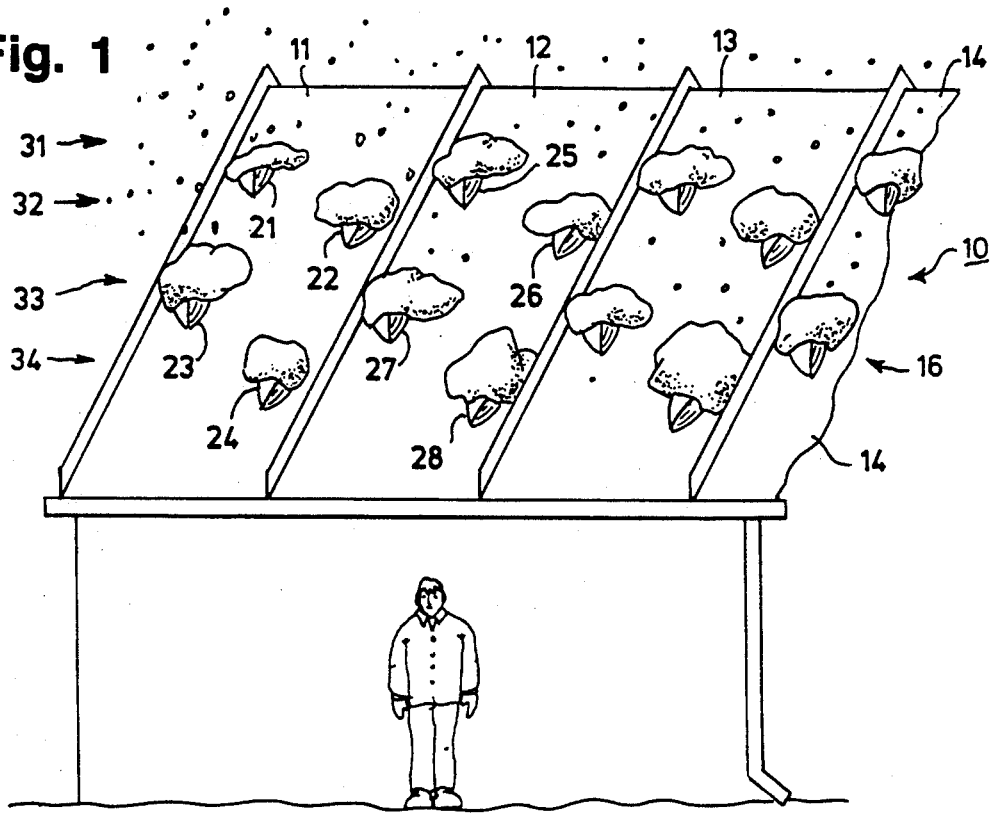
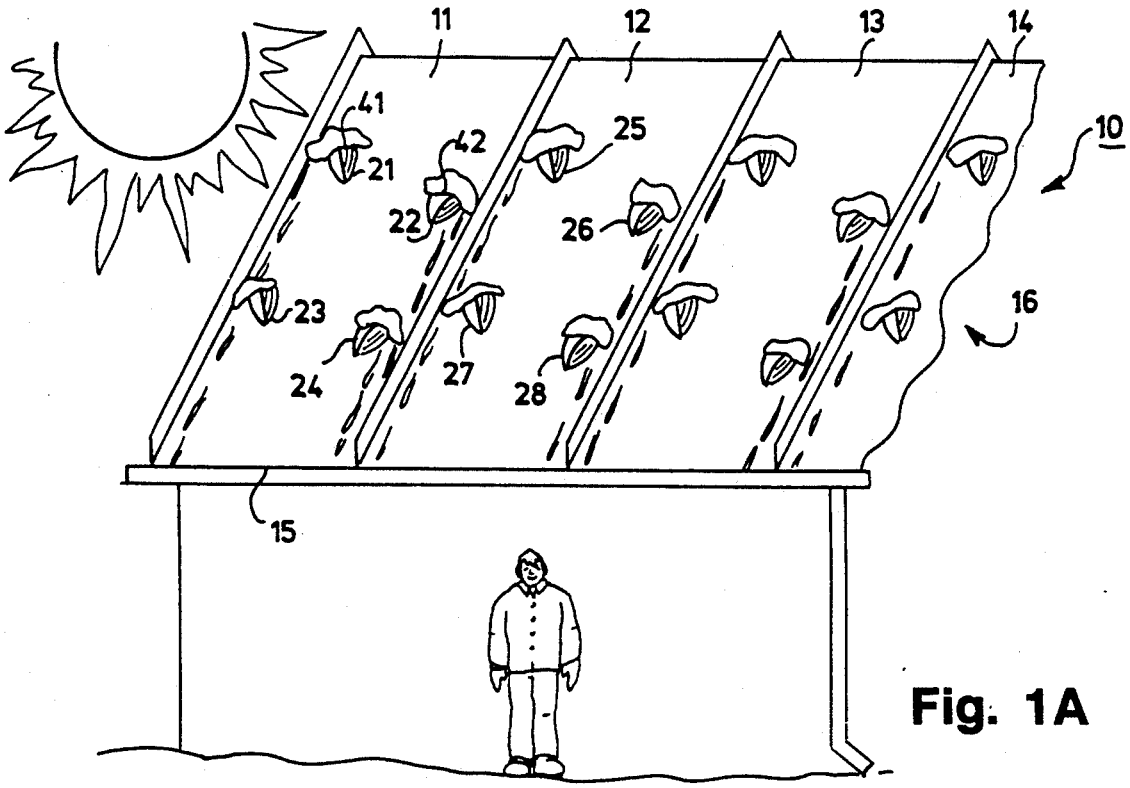
Fig. 1A

ROOFING SNOW PANEL AND METHOD OF CONSTRUCTING SAME

DESCRIPTION

1. Technical Field

The present invention relates in general to a metal roof construction and a method of constructing same to provide precipitation control. More particularly, the present invention relates to a metal panel construction and method of constructing it for helping to prevent or at least reduce greatly dangerous avalanches of accumulated snow or ice.

2. Background Art

Pitched architectural roofing employing standing seam metal panels have experienced tremendous growth in recent years. For example a recent survey disclosed that installed pitched metal roofs increased from 60 million square feet in 1985 to over 165 million square feet in 1989—an annual growth rate of almost twenty-nine percent.

With such a dramatic increase in installed pitched metal roofs there has been a corresponding awareness of the need for a roofing construction which is not only durable and less susceptible to snow or ice damage but also a construction which prevents or at least greatly reduces ice and accumulated snow from sliding down such a roof. In this regard, avalanches of snow or ice can accumulate atop various building structures with sloping roofs. The wider the roof and the steeper its pitch, the greater the chance of a serious avalanche that may result in unwanted and unexpected injuries.

Therefore, it would be highly desirable to have a new and improved panel construction which would not only be durable but which would also prevent, or at least greatly reduce the chance of a serious avalanche of accumulated snow or ice.

Because of the dangers imposed by snow or ice accumulating on a steep roof, many attempts have been made to prevent unwanted and undesired avalanches. For example, in certain snow regions of the country, people have attempted to prevent such avalanches by installing or using a plurality of individually and separately attached upright barriers glued to a panel along the lower peripheral edges of a steep roof. While such barriers help prevent avalanches, they have proven to be less than satisfactory. In this regard, the individually attached barriers are unsightly, and they tend to unglue and rot if made from organic materials such as wood, or alternately to corrode if constructed from metal. Similarly, the barriers can cause the accumulation of standing water because of their shape, and thus they can easily corrode.

There is, therefore, a need for a new and improved panel construction which is architecturally aesthetically pleasing to the sight of a viewer, and which is also highly resistant to corrosion or other unsightly wear and which incorporates retardation within the panel itself.

U.S. Pat. No. 4,141,182 discloses a roof construction which utilizes a series of spaced-apart staggered plastic barriers mounted across an entire roof. The plastic barriers, arranged in a staggered pattern, help break up the flow of snow or ice. While the foregoing snow guards may help to break up the flow of snow or ice from a steep roof, the installation of such devices is time consuming and expensive. Moreover, because such devices are mounted directly into the roof paneling, holes are created, which can open further under repeated stress from heavy snow or ice, thereby exerting pressure against such upstanding guards.

Therefore, such a new and improved panel construction should be relatively inexpensive and should not require special expensive installation procedures.

DISCLOSURE OF INVENTION

Therefore, the principle object of the present invention is to provide a new and improved panel construction which prevents or at least greatly reduces dangerous avalanches of accumulated snow or ice from wide steeply pitched roofs and the like.

Another object of the present invention is to provide such a new and improved panel construction which is architecturally aesthetically pleasing in appearance and which is not subject to accelerated corrosion or undue wear resulting from repeated exposure to the elements of nature, such as snow or ice.

Still yet another object of the present invention is to provide such a new and improved panel construction that does not require special installation procedures and that is relatively inexpensive to install when a roof is covered with a construction material.

Briefly, the above and further objects of the present invention are realized by providing a new and improved panel construction with a plurality of integrally formed spaced-apart upstanding truncated projections which hold accumulating precipitation in the form of snow in stasis from movement. Such projections are pre-formed into a pre-dimensioned roofing panel and are so constructed and arranged to inhibit or at least greatly retard an unwanted build-up of precipitation.

Each panel is formed from sheet metal, having a front surface with a plurality of spaced apart integrally formed upstanding projections. Each projection is configured in a smoothly rounded contoured body portion having a generally flat contoured front wall with a smooth outer face to inhibit the downward motion of accumulated snow or ice on the panel. The body portion of each projection is generally triangularly shaped in cross section throughout its longitudinal dimension for strengthening the body and wall under snow or ice loading. The front wall of each projection is disposed at an acute angle relative to the transverse dimension of its associated panel for helping to prevent the accumulation of standing water as accumulated snow or ice melts gradually.

In one form of the invention similar projections are staggered and angularly displaced relative to one another. In another form of the invention different type of projections are spaced apart and aligned relative to one another. In still yet another form of the invention, similar projections are spaced apart and randomly arranged relative to one another. These pattern arrangements, coupled with the arresting wall of each projection, prevents or at least greatly reduces, the accumulation of liquids and breaks up the flow of moving precipitates.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein:

FIGS. 1 and 1A are pictorial views of a roofing construction, which is constructed in accordance with the present invention and which is shown installed on a pitched roof surface;

BEST MODE FOR CARRYING OUT THE INVENTION

Figure 2:
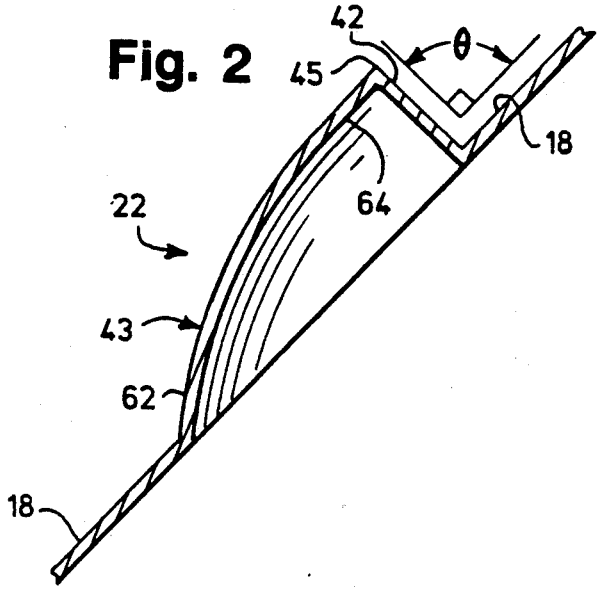
FIG. 2 is an enlarged fragmentary transverse sectional view a single, projection of a panel construction of FIG. 1.

Referring now to the drawings and more particularly to FIG. 1 thereof there is shown a roofing construction 10 which is constructed in accordance with the present invention and which is shown illustratively installed on a pitched upper building surface or roof 16.

The roofing construction 10 generally comprises a plurality of metallic panels 11-14 which are dimensioned for covering a particular portion of a pitched building surface. Each panel contains one or more integrally formed smoothly rounded contoured projections or protuberances such as the projections 21-24 and 25-28 for helping to prevent or at least for helping to reduce greatly dangerous avalanches of accumulated snow or ice. In this regard, when like panels 11-14 are arranged in an abutting manner as best seen in FIG. 1, the projections thereon are so arranged and constructed to form a plurality of rows of barriers, such as rows 31-34 respectively for helping to hold accumulated snow or ice in equilibrium. Holding snow or ice in its originally deposited position is an important feature of the present invention as this enables the accumulated snow or ice to melt gradually and to drain off into the gutters and downspouts of the building.

Although in the preferred embodiment of the present invention only four rows of barriers are disclosed, it will be understood by those skilled in the art that a greater number of rows may be required in those regions of the country where there is a greater accumulation of snow.

Considering now the panels 11-14 in greater detail with reference to FIGS. 1-4, the panels 11-14 are substantially identical so only panel 11 will be described in greater detail. In this regard, panel 11 is composed of architectural sheet metal which is highly resistant to corrosion. The sheet metal is selected from the group of metals consisting of galvanized or zinc coated steel, aluminum, copper, tin, lead, zinc, lead coated copper, micro zinc and stainless steel. Such structural alloys may also be coated with a primer paint and a thin layer of fluorocarbon paint such as Kynar 500 TM. Although in the preferred embodiment of the present invention the sheet metal is selected from the foregoing group, it will be understood by those skilled in the art that other types and kinds of alloy metals may be utilized. It will also be understood by those skilled in the art, that depending upon certain selected alloys which are known for their natural weathering and permanence, there is no need for primers and paint coatings. Elimination of such coatings also helps to eliminate the possibilities of paint fractures which are formed during the manufacturing process.

The panel 11 is formed from a roll of selected sheet metal of a given width which is passed through, over and under a series of rollers. The rollers include preformed notches and teeth which distort, stretch and form the projections 21-24 in the metallic material. After the projections, such as projections 21-24 are formed at selected locations, the sheet metal is cut at a given length for covering a particular roof, such as a roof 16. Although the preferred method of forming the panel 11 is a roll-forming technique, it will be understood by those skilled in the art that panels with integrally formed projections may also be formed by a hand tool process or a punch and die process. In this regard, the preferred process for forming the panel and its associated projections depends upon the type of alloy being used in the panel, the overall shape of the projection and its height.

Considering now the projections 21-28 in greater detail with reference to FIGS. 1-4, the projections 21-28 are arranged in spaced-apart rows with at least one projection per row. For example, projections 21 and 25 form two of the projections in row 31, while projections 22 and 26 form two of the projections in row 32. Although in the preferred embodiment of the present invention each panel contains at least one projections per row, it will be understood by those skilled in the art that a greater or lesser number of projections is possible depending upon the width of the panels.

The projections in each row, such as the projections in rows 31-34 are spaced apart along the longitudinal dimension of the panel 11. In this regard, for a panel eight feet in length, the lower row of projections 34 is spaced apart from the next row of projections 33 by about 30 inches and from a lower edge 15 of the panel by about 18 inches. Should a greater number of rows be required due to larger accumulations of snow, such rows would be spaced apart preferably from one another by about 30 inches. Although in the preferred embodiment of the present invention, the rows of projections are spaced apart by about 30 inches, it will be understood by those skilled in the art that greater or lesser spacing dimensions may be employed depending upon the pitch of the roof, the length of the panel and the average annual accumulation of snow in the region where the panels are to be installed.

As best seen in FIG. 1, the projections, such as projections 21 and 22 are also spaced apart along the transverse dimension of the panel 11. In this regard, for a four foot wide panel each projection is about between three to twelve inches wide and spaced apart from its associate projection between about four inches to about thirty inches. The rows of projections may also be aligned or staggered depending upon snow loading requirements and desired aesthetic appearances. For example, projection 21 is spaced-apart from a left edge 17 of the panel 11 by about three inches, while projection 22 is spaced apart from the left edge 17 by about thirty-nine inches. Such a staggered arrangement or pattern helps to deflect or break up sliding accumulated snow or ice. Thus, a preferred staggered spacing for two projections is between about 2 inches to about 40 inches. A more preferred spacing is between about 3 inches to about 30 inches. The most preferred spacing is about 4 inches. Although in the preferred embodiment of the present invention, the rows of projections are staggered relative to a 48 inch wide panel, it will be understood by those skilled in the art that other spacing dimensions may also be employed depending upon the width of the projections, the expected average annual snow accumulations, desired aesthetic appearances, and the width of the panel. Moreover, the projections may also be randomly disposed relative to one another.

In order to help retain the accumulated snow or ice in equilibrium so it may gradually melt and drain off the roof 16, each projection, such as the projection 22, include a body member 43 configured in a smoothly rounded contoured shaped back body having a generally contoured front wall 42 defining a front outer face for helping to arrest downward motion of accumulated snow or ice on the roofing panel 11. The front wall 42 (FIGS. 1 and 2) extends upwardly from an upper surface portion 18 of the panel 11 terminating at a smoothly rounded upper peripheral edge 45 extending across the entire width of the projection 22. The back body member 43 slopes downwardly and rearwardly from the smoothly rounded peripheral edge 45 to terminate in a common juncture 58. The body member 43 is generally triangularly shaped in cross section throughout its longitudinal dimension for strengthening the body member 53 with a sufficient amount of strength to prevent its collapse when subjected to snow or ice loading.

As best seen in FIG. 2, the front wall 42 extends upwardly from the upper surface 18 of the panel at an angle $\theta$ in order to eliminate or at least greatly reduce avalanches of accumulated snow or ice. In this regard, the projection 22 holds such accumulations in equilibrium so the snow or ice may melt gradually and drain off the roof 16. A preferred angle $\theta$ is between about eighty-six degrees and about ninety-four degrees. A more preferred angle $\theta$ is between about eighty-eight degrees and about ninety-two degrees and the most preferred angle $\theta$ is about ninety degrees.

In order to define a sufficiently high arresting surface for holding snow or ice in equilibrium, the projections, such as the projections 21 and 23 extend upwardly from the upper surface 18 a predetermined distance d. In this regard, a preferred distance d is between about 1/16 inch and about 4 inches. A more referred distance d is between about ½ inch and about 3 inches and a most preferred distance d is about 2 inches.

Also in order to help eliminate standing water, each front wall, such as the front wall 42 is disposed at an angle $\beta$ relative to the lower edge portion 15 of the panel 11. In this regard the angle $\beta$ is between about 1 degree and about 10 degrees. A more preferred angle $\beta$ is about 1 degree and about 5 degrees, and the most preferred angle $\beta$ is about 2 degrees. It should be understood that the angle $\beta$ is expressed in complementary values because adjacent projections, such as the projections 23 and 24 are so arranged and constructed to be oriented at complementary angles relative to one another. For example, as best seen in FIG. 1, the projections 23 and 24 should be oriented at 182 degrees and 358 degrees respectively relative to the plane of the lower edge 15.

Considering projections 21–24 in still greater detail with reference to FIGS. 1–4, projections 21–24 are substantially identical in their overall dimensions and shapes. Accordingly, only the projection 22 will be described hereinafter in greater detail.

Referring now to FIG. 2 the body portion 43 projects slopingly upwardly from the upper surface 18 to define in plan view (FIG. 4) a generally semi-elliptically smoothly rounded contoured shaped having a straight edge 52 which is disposed between a pair of curvilinear side edges 54 and 56. The side edges 54 and 56 converge together at the common junction 58.

In cross section, the body member 43 has a generally triangular or semi-bullet shape and includes a generally upwardly sloping curved portion 62 which extends from the upper surface 18 of the panel 11 to a integrally connected substantially flat straight top portion 64. The top portion 64 is substantially parallel to the upper surface 18 of the panel 11. The top portion 64 terminates at its opposite terminal end at the upper edge portion 45 of the wall 42.

Figure 3:
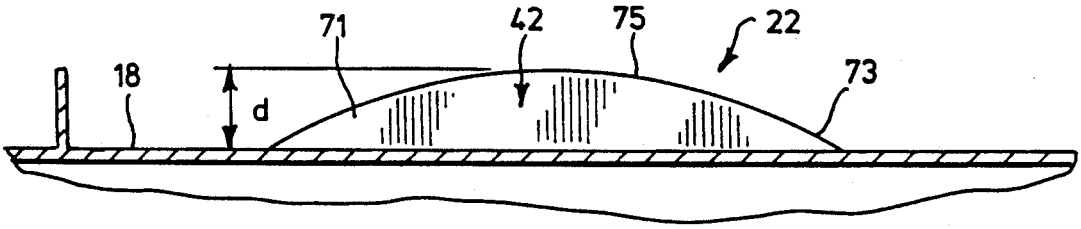
FIG. 3 is an enlarged fragmentary front sectional view of the projection of FIG. 2.
Figure 4:
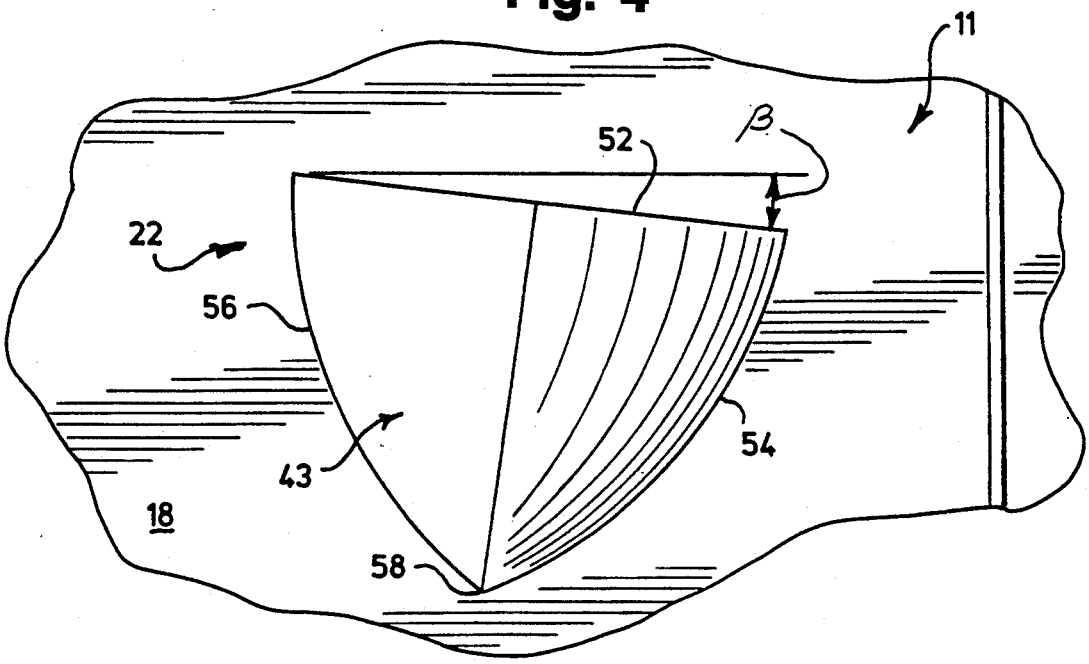
FIG. 4 is a plan view of the projection of FIG. 2.

Considering now the front wall 42 with reference to FIGS. 2 and 3, the front wall 42 has a generally truncated semi-circular shape with a substantially smooth face. The wall 42 is defined by a straight bottom edge portion 71 and a smoothly rounded curvilinear edge portion 73. The curved portion 73 extend between the terminal ends of the bottom edge portion 71.

The wall 42 has a transverse dimension that is proportioned relative to the transverse dimension of the panel 11. In this regard, the ratio between the transverse dimension of the wall 42 and the transverse dimension of the panel 11 is between about 1 to 48 and about 11 to 24. A more preferred ratio is between about 1 to 24 and about 12 to 48. The most preferred ratio is about 1 to 16.

Referring now to the drawings and more particularly to FIGS. 5, 5A and 6–17 there is shown another roofing construction 110, which is also constructed in accordance with the present invention and which is similar to roofing construction 10. The roofing construction 110 includes a set of metallic roofing panel 111–117 each of which is similar to panel 11. The panels 111–117 are similar to the panel 11 with the exception of width, and the type and number of projections or protuberances disposed thereon.

Considering now panels 111 and 112 greater detail with reference to FIGS. 5, 5A, and 6–8, the panel 111 and 112 each include a plurality of spaced apart randomly disposed smoothly rounded contoured shaped projections, such as the projections 121–122 and 123–124 respectively for helping to inhibit or at least retard greatly dangerous avalanches of accumulated snow or ice. The projections 121–124 are integrally formed in their respective panels and are similar to the projections 21–24 except for their shape and placement on separate panels. As the projections 121–122 and 123–124 are substantially similar to one another except for their orientation on their respective panels, only projection 121 will be described hereinafter in greater detail.

Figure 8:
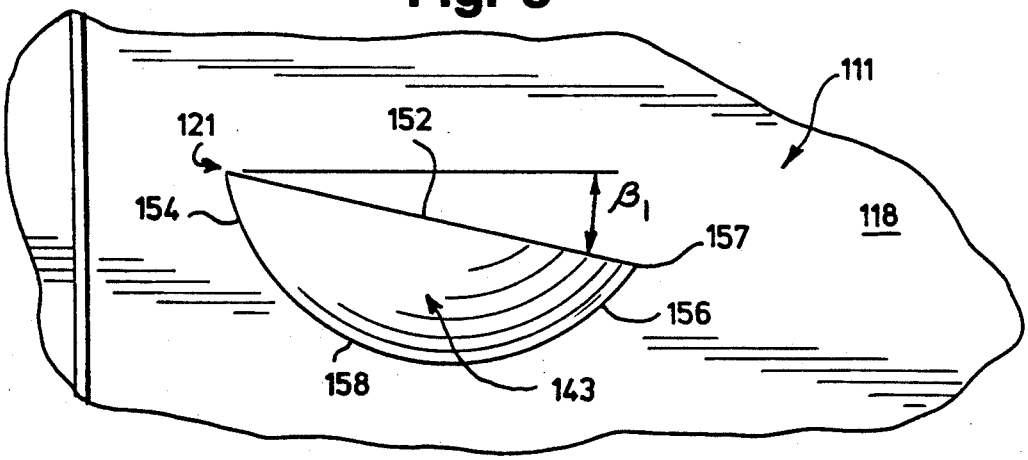
FIG. 8 is a plan view of the projection of FIG. 6.

Considering now projection 121 in greater detail with reference to FIGS. 6–9, the projection 121 includes a semi-spherical shaped back body portion 143 having a generally outwardly inclined front wall portion 141 that defines a smooth outer face to inhibit the downward motion of accumulated use or snow on the panel. As best seen in FIG. 8 the body portion 143 in plan view has a generally smoothly rounded truncated semi-circular shape and includes a straight edge portion 152, and a smoothly rounded curvilinear edge portion 154 that extends between the terminal ends of the straight portion 152.

Figure 6:
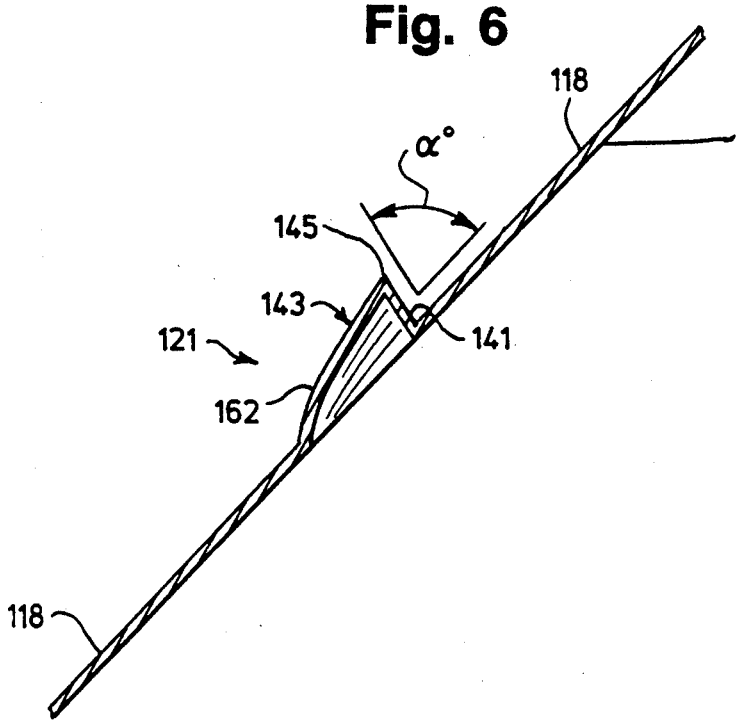
FIG. 6 is an enlarged transverse sectional view of a single projection of a panel construction of FIG. 5.
Figure 7:
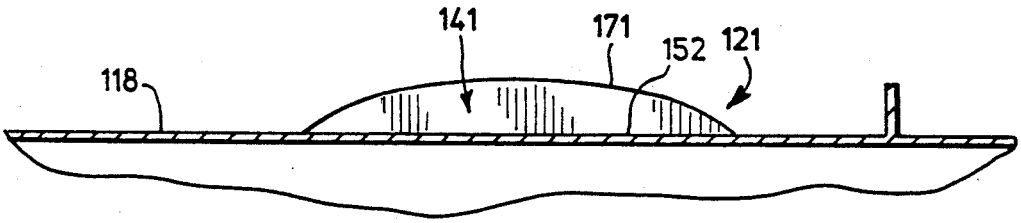
FIG. 7 is an enlarged fragmentary front sectional view of the projection of FIG. 6.

In cross section, as best seen in FIG. 6, the back body member 143 is generally triangularly shaped and includes a single upwardly inclined curved portion 162 which extends between an upper surface 118 of the panel 111 and a smoothly rounded upper edge portion 145 of the wall 141.

Considering now the wall 141 in greater detail with reference to FIGS. 6–9, in front elevational view, the wall 141 has a general semi-elliptical shape having a single curved edge portion 171 which extends between the terminal ends of a bottom edge portion 152. As best seen in FIG. 6, the wall 141 is joined integrally along its base or bottom edge 152 to the upper surface 116 and extends upwardly therefrom at an angle $\alpha$. The angle $\alpha$ is between about 86° and about 90°. A most preferred angle $\alpha$ is about 90°. The wall 141 extends upwardly from the surface 118 by a predetermined distance and terminates at its smoothly rounded upper peripheral edge 145 to define an arresting surface for inhibiting sliding snow or ice.

As best seen in FIG. 8, the wall 141 is disposed at an angle $\beta_1$ relative to the transverse dimension of the panel 111 for helping to prevent standing liquids. In this regard, as accumulated snow or ice melts forming liquid, the liquid flows down the panel 111 and against the wall 141 of projection 121. The wall 141 disrupts the flow of such liquid causing it to be diverted outwardly and downwardly along the base of the wall until it reaches an outer terminal edge portion 157 of the wall. At the terminal edge portion 151 the liquid is free to flow downwardly under the force of gravity to the lower edge of the panel 111 for accumulation in a gutter or drain system shown generally at 119. A preferred angle $\beta_1$ is between about 1° and about 45°. A more preferred angle $\beta_1$ is about 3° and about 6°. A most preferred angle $\beta_1$ is about 5°.

Considering now panels 113 and 114 in greater detail with reference to FIGS. 5, 5A, and 9–11, the panels 113 and 114 each include a plurality of spaced apart randomly disposed projections 221–222 and 223–224 respectively for helping to prevent or at least reduce greatly dangerous avalanches of accumulated snow or ice. The panels 113 and 114 are similar to panel 11 with the exception of width and the type and number of projections or protuberances disposed thereon. The projections, such as the projections 221 and 223 are arranged in staggered spaced apart rows when the panels; such as the panels 113 and 114 are installed in abutting relationship on the surface of a roof. The projections 221–222 and 223–224 are smoothly rounded contoured in configuration and are integrally formed in the panels 113 and 114 respectively. The projections 221–224 are similar to the projections 21–24 except for their shape and size. As the projections 221–224 are substantially similar to one another, only projection 221 will be described hereinafter in greater detail.

Figure 9:
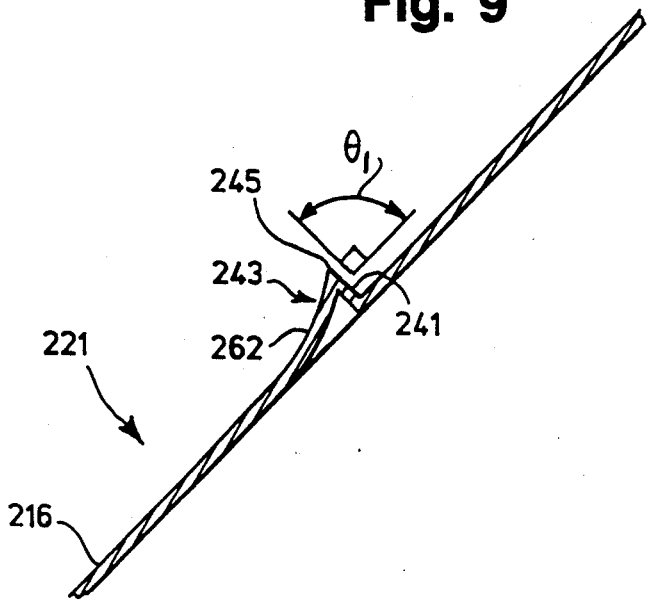
FIG. 9 is an enlarged transverse sectional view of another projection of another panel construction of FIG. 5.
Figure 10:
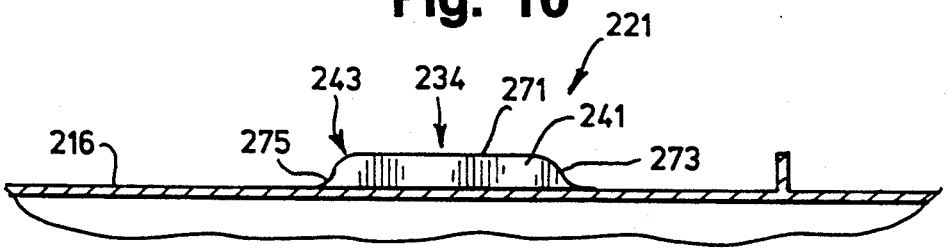
FIG. 10 is an enlarged fragmentary front elevational view of the projection of FIG. 9.
Figure 11:
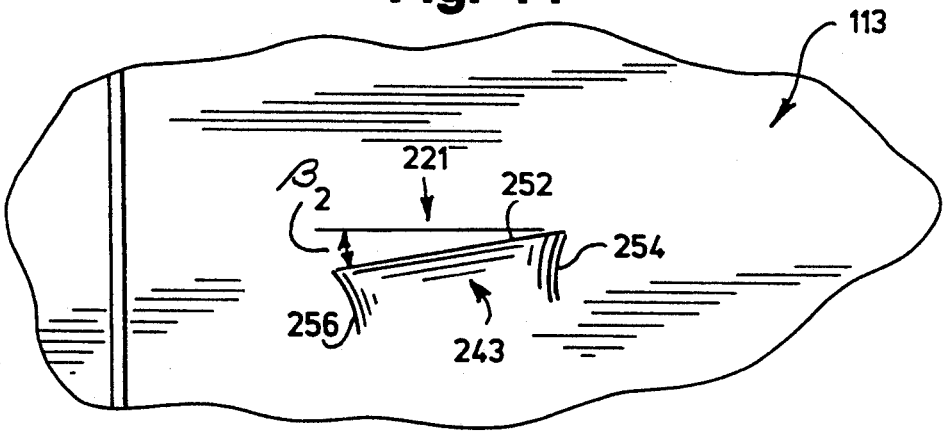
FIG. 11 is a plan view of the projection of FIG. 9.

Considering now the projection 221 in greater detail with reference to FIGS. 9–11, the projection 221 includes a wedge shaped upwardly inclined rounded back body member 243 having a straight substantially perpendicularly disposed front wall 241 with a smooth outer face. As best seen in FIG. 11, the body member 243 in plan view includes a straight edge portion 252, which is integrally connected between a pair of inwardly flared curved edge portions 254 and 256 respectively. In cross section, the body member 243 is triangularly-shaped and includes an upwardly inclined curve edge portion 262 which extends between an upper surface 216 of the panel 211 and a contoured upper edge portion 245 of the wall 241.

Considering now the wall 241 in greater detail with reference to FIGS. 9–11, the wall 241 includes a pair of spaced apart rounded side edge portions 273 and 275 respectively, which are integrally connected at opposite ends of a straight upper flat edge portion 271. The straight edge portion 271 is generally parallel with the upper surface 216. The curved edge portions 273 and 275 slope downwardly from the straight edge 271 terminating at the surface 216.

As best seen in FIGS. 10 and 11, the wall 241 defines an arresting surface for helping to hold accumulated snow or ice in a generally equilibrium state so that it may gradually melt and drain off the roof construction 110. The wall 241 extends upwardly from the upper surface 216 at a angle $\theta_1$ where the angle $\theta_1$ is between about 88° and about 92°. A more preferred angle $\theta_1$ is between about 89° and about 91°, and a most preferred angle $\theta_1$ is about 90°.

Also as best seen in FIG. 11, the wall 241 is disposed at an angle $\beta_2$ relative to the horizontal plane of the panel 113 for helping to prevent the accumulation of liquid formed from melting snow or ice. A preferred angle $\beta_2$ is between about 1° and about 20°. A more preferred angle $\beta_2$ is about 3° and about 15°, and a most preferred angle $\beta_2$ is about 5°.

Considering now panels 115 and 116 in greater detail with reference to FIGS. 5, 5A and 12–14, the panels 115 and 116 are substantially identical except for the angular displacement of the projections disposed thereon. The panels 115 and 116 are similar to panel 11 with the exception of width and the number and kinds of projections disposed thereon. In this regard, a plurality of spaced apart smoothly rounded contoured projections 321–322 and 323–324 are disposed on panels 115 and 116 respectively for helping to control the discharge of accumulated snow or ice from a pitched roof.

Figure 5:
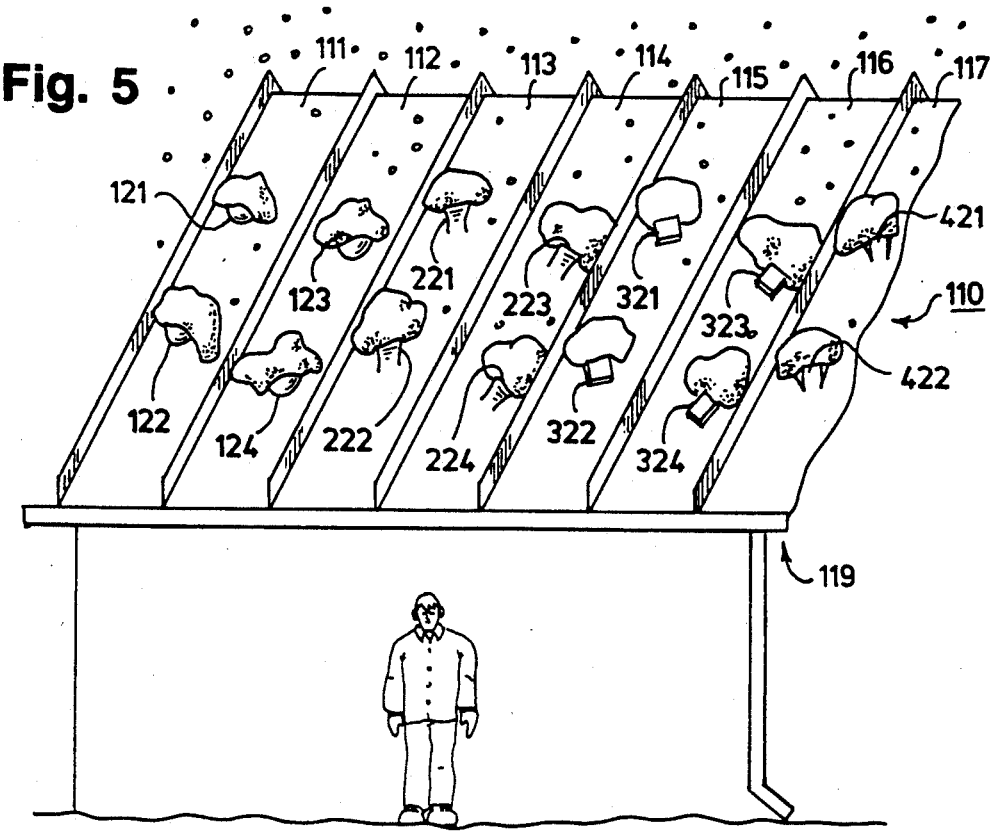
FIG. 5 and 5A pictorial views of another roofing construction which is constructed in accordance with the present invention and which is shown installed on a pitched roof surface.
Figure 5A:
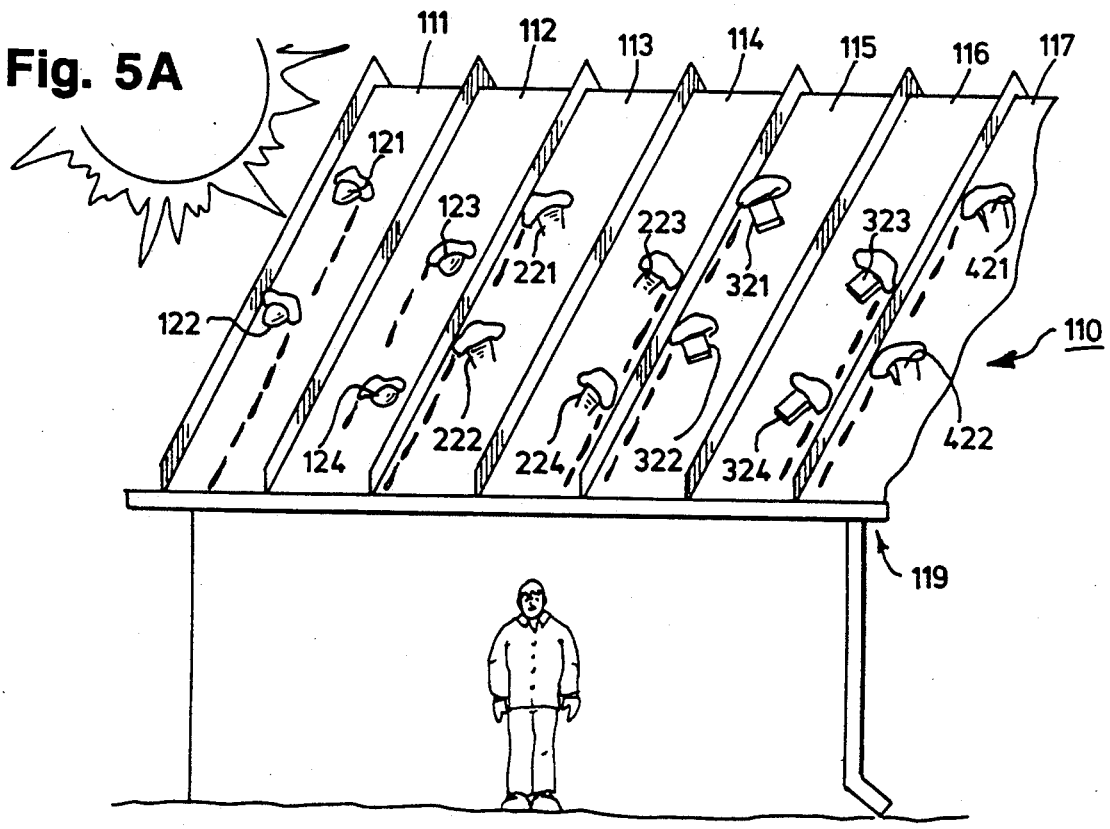
Figure 14:
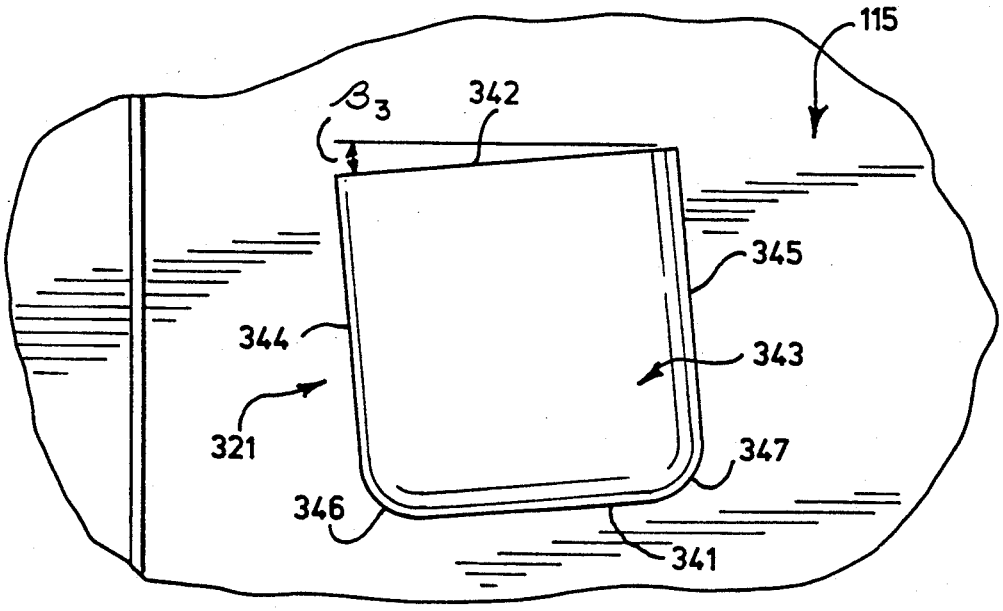
FIG. 14 is a plan view of the projection of FIG. 12.

As best seen in FIGS. 5, 5A and 14, each projection, such as the projection 321 is disposed at an acute angle $\beta_3$ relative to the transverse dimension of its associated panel. The angle $\beta_3$ is between about 1° and about 5°. A more preferred angle $\beta_3$ is between about 2° and about 4°. A most preferred angle $\beta_3$ is about 3°. As each of the projections 321–324 are substantially similar only projection 321 will be described in greater detail.

Figure 12:
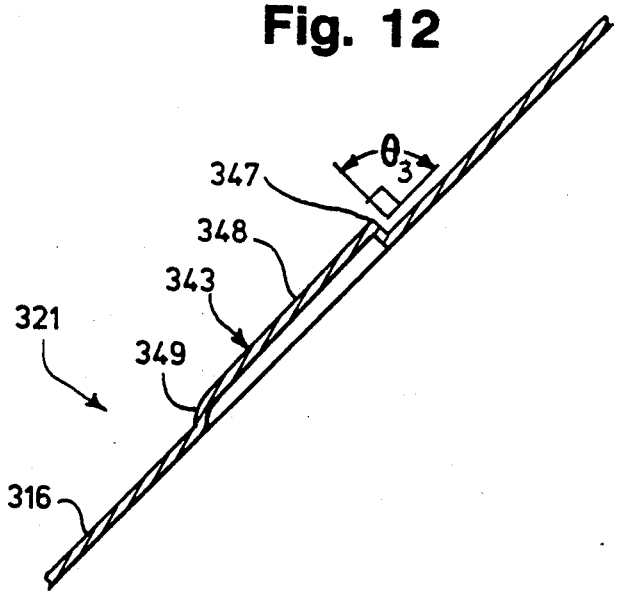
FIG. 12 is an enlarged transverse sectional view of another projection of another panel construction of FIG. 5.
Figure 13:
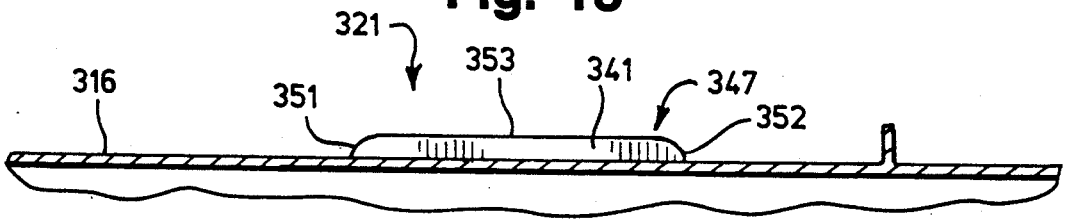
FIG. 13 is an enlarged fragmentary front elevational view of the projection of FIG. 12.

Considering now the projection 321 in greater detail with reference to FIGS. 12–14, the projection 321 is integrally formed in the panel 115 and includes a generally flat back body member 343 which in plan view is substantially rectangular in shape having a front wall 341 defining a front outer face. The wall 341 extends from the upper surface 316 of the panel 115 to a contoured edge portion. In plan view, as best seen in FIG. 14, the body member 343 includes a pair of parallel spaced apart lower and upper edge portions 341 and 342 respectively. The projection 321 also includes a pair of parallel spaced apart side edge portion 344 and 345 which are disposed and integrally connected at opposite ends of the upper leg member 342. The side edge portions 344 and 345 are integrally connected to the bottom edge portion 341 by a pair of curve edge portions 346 and 347 respectively.

As best seen in FIG. 12, in cross section the body member 343 has a generally rectangularly shaped and projects upwardly from an upper surface portion 316 of the panel 115. In this regard, the body member 343 includes a large flat upper surface area 348 that is in a substantially parallel plane with the upper surface 316 and a short rise portion 349 which is integrally connects the panel surface 316 with the upper surface area 348.

As best seen in FIG. 13, the wall 341 is generally rectangular in shape having a pair of spaced-apart rounded side edges 351 and 352 respectively which are interconnected at opposite ends of a straight edge 353. The straight edge 353 defines the top peripheral edge portion 347 of the wall. The side edges 351 and 352 extend downwardly and outwardly from the straight edge 353 and terminate at the upper surface 316.

As best seen in FIG. 12, the wall 341 is disposed at an angle $\theta_3$ relative to the upper surface 316. In this regard the angle $\theta_3$ is between about 86° and 94°. A more preferred angle $\theta_3$ and 87° and 93°. The most preferred angle $\theta_3$ is about 90°.

Considering now the panel 117 in greater detail with reference to FIGS. 5, 5A and 15–17, the panel 117 is substantially similar to panel 11 except for its width and the number and type of projections disposed thereon. In this regard, the panel 117 includes a plurality of spaced apart randomly disposed smoothly rounded contoured projections or protuberances 421 and 422 which help prevent dangerous avalanches of snow or ice. The projections 421 and 422 are similar to projections 121 and 122 except for their overall shape and size and are similar to one another. As the projections 421 and 422 are similar to one another only projection 421 will be described in greater detail.

Considering now the projection 421 in greater detail with reference to FIGS. 5, 5A and 15–17, the projections 421 is integrally formed in the panel 117 and projects upwardly therefrom a predetermined distance for defining a barrier. In this regard, the projection 421 generally defines a smoothly contoured wedge-shaped back body 424 having a contoured front wall 441 with a substantially flat smooth front outer face portion. The wall 441 projects upwardly from at the upper surface 416 of the panel 117 at an angle $\theta_4$.

Figure 17:
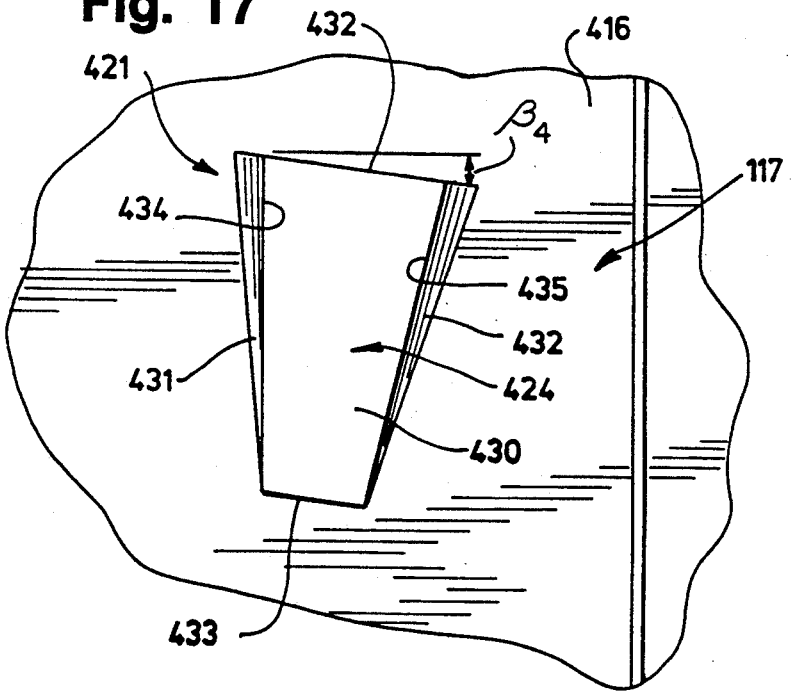
FIG. 17 is a plan view of the projection of FIG. 15.

As best seen in FIG. 17, the body portion 424 includes a substantially flat top surface area 430 which is disposed between a pair of generally triangularly shaped tapered side member portions 431 and 432 respectively. The side member portions 431 and 432 extend between the upper surface 416 of the panel and the top surface area 430 to define a pair of generally upwardly sloping surfaces.

Considering now the body portion 424 in still greater detail with reference to FIG. 17, in plan view the top surface area 430 has a general trapezoidal shape defined by a pair of spaced apart top and bottom edges 432 and 433 respectively. The edges 432 and 433 are disposed between a pair of non-parallel side edges 434 and 435 respectively.

Figure 15:
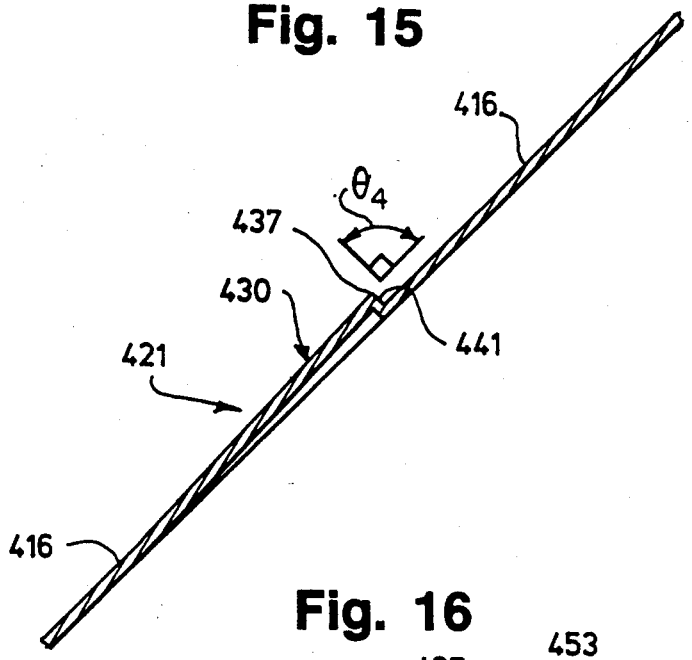
FIG. 15 is an enlarged transverse sectional view of another of another panel construction of FIG. 5.

In cross section, as best seen in FIG. 15, the projection 421 has a general triangular shape defined by edge 436 which extends upwardly slopingly from the upper surface 416 from the bottom edge 433 to the top edge 432.

Figure 16:
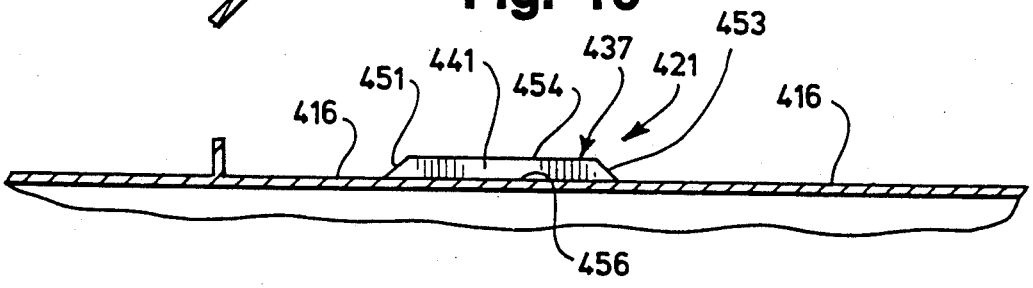
FIG. 16 is an enlarged fragmentary front elevational view of the projection of FIG. 15.

Considering now the wall 441 in greater detail with reference to FIG. 16, the wall 441 has a general trapezoidal shape having a pair of non-parallel side edges 451 and 453 respectively and a pair of parallel top and bottom edges 454 and 456 respectively.

As best seen in FIG. 15, the wall 441 projects upwardly from the top surface 416 at the angle $\theta 4$ which is between about 84° and about 96° relative to the plane of the top surface. A more preferred angle $\theta 4$ is between about 86° and about 94°. A most preferred angle $\theta_4$ is about 90°.

Also as best seen in FIG. 15, the face portion 441 projects upwardly from the surface 416 a sufficient distance d to define an arresting surface for blocking or holding snow and in equilibrium. The maximum height of the wall depends on the type of metallic material the panel 117 is composed of, the snow loading requirements, and the general appearance to be achieved with the panel 117 when it is installed on a pitched roof surface. In this regard d is between about 1/16" to about 4". A more preferred d is between about 1" and about 3". A most preferred d is about 2".

Figure 18:
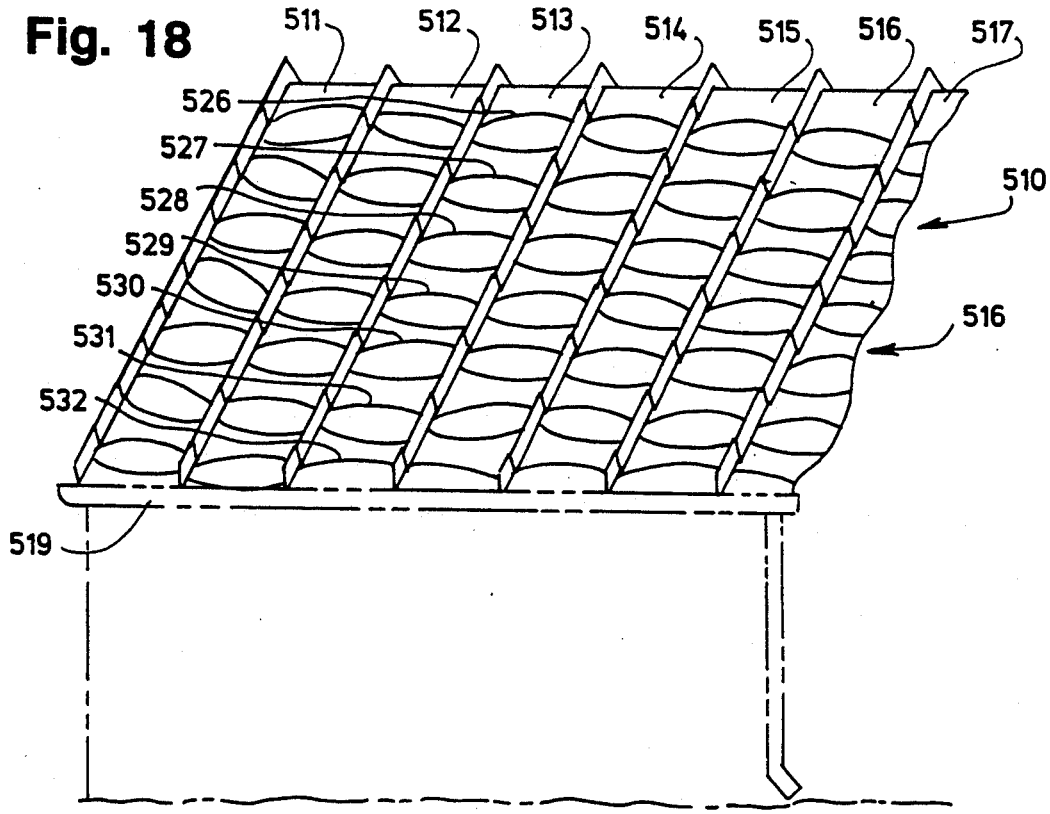
FIG. 18 is a pictorial view of a roofing construction, which is constructed in accordance with the present invention and which is shown installed on a pitched roof surface.
Figure 19:
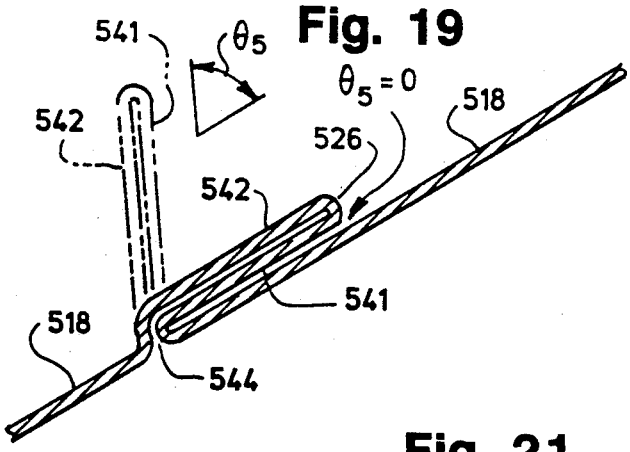
FIG. 19 is an enlarged fragmentary transverse sectional view of projection of FIG. 20.
Figure 20:
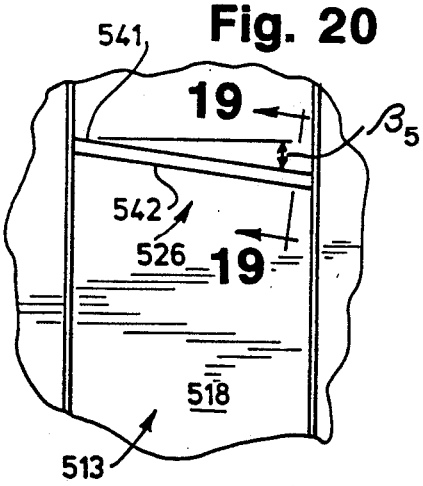
FIG. 20 is a plan view of the projection of FIG. 18.
Figure 21:
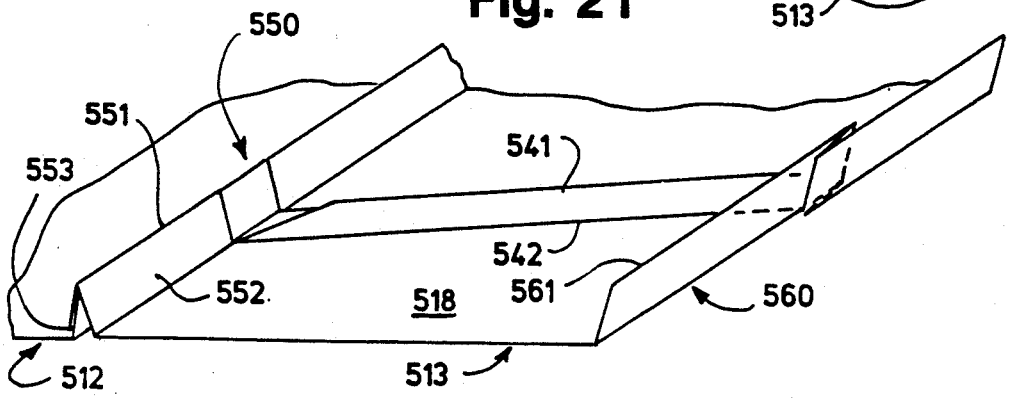
FIG. 21 is an enlarged fragmentary pictorial view of a panel forming part of the panel construction of FIG. 18.

Referring now to the drawings and more particularly to FIGS. 18–20 there is shown another roofing construction 510, which is also constructed in accordance with the present invention and which is similar to roofing construction 10. The panel construction 510 generally includes a set of standing seam panels 511–517, which are interconnected to cover the surface of a roof 516.

Considering now the panels 511–517 in greater detail, only panels 513 and 514 will be described in greater detail as panels 511, 512 and 515–517 are substantially similar standing panels. The panels 511–517 are interconnected by interconnecting individual upstanding seams. In this regard, each panel 511–517 includes a right hand upstanding male seam member 560 and a left hand upstanding female seam member 550. The female member is generally V-shaped having an outer wall member 551 and an inner wall member 552.

Considering now panel 513 in greater detail, panel 513 includes a plurality of spaced apart projections such as projections 526–532 respectively. As will be explained hereinafter, the projections 526–532 are formed by folding the panel 513 transversely at various designated areas along its longitudinal length. When so folded, the projections 526–532 define a set of barriers which help eliminate or at least greatly reduce avalanches of accumulated snow or ice. As projections 526–532 are substantially similar to one another, only projection 526 will be described hereinafter in greater detail.

Considering now projection 526 in greater detail, the projection 526 includes a front wall portion 541 that defines a smooth outer face to inhibit the downward motion of accumulated snow on panel 513 and a back-wall portion 542. In cross section, as best seen in FIG. 19, the front wall portion 541 and the back wall portion 542 are substantially parallel to one another. Both the front wall portion 541 and the back wall portion 542 are joined integrally at bottom edges 543 and 544, respectively, to the upper surface 518 and extend upwardly therefrom at an angle $\downarrow_5$. The angle $\downarrow_5$ is between 0° and 90°. A more preferred angle $\downarrow_5$ is between about 10° and 80°. The most preferred angle $\downarrow_5$ is about 15°.

As best seen in FIG. 20, the walls 541 and 542 are disposed at an angle $_{62\,5}$ relative to the transverse dimension of the panel 513 for helping to prevent standing liquids. The preferred angle $\beta_5$ is about 1°.

The projection 526 is formed by first crimping in a transverse dimension a lower portion of the sheet over an upper portion of the sheet. The lower portion is then crimped back down, at a distance offset and parallel from position of the first crimp.

The male seam member is formed by crimping a portion of the sheet, shown generally at 560, in a longitudinal dimension, at a given offset distance and parallel from a given edge portion 561 of the sheet, towards a top surface 518 of the sheet until an angle of about 90° is formed.

The female seam member 550 is formed by crimping the sheet towards the top surface 518 in a longitudinal dimension, at another given distance, which is about two times larger than the other offset distance and parallel from another edge 553, opposite of the male seam member 560 to form an inverted sheet portion 552. The inverted sheet portion is simultaneously crimped in a longitudinal dimension at a yet another distance, which is equal to about one half of said second given offset distance, and parallel from the other edge, back on top of itself to form a folded portion. The folded portion is then pressed up and away from the top surface until the top surface and the fold portion are at angle relative to one another.

When the projection is thus raised, it forms an angle between about 0° and about 90° between the top surface and the face portion of the projection.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A roofing panel for holding accumulated snow in equilibrium, comprising:

a sheet of metallic material having an upper surface and having a transverse and a longitudinal dimension;

said sheet of material having a generally rectangular shape and including a plurality of integrally formed smoothly rounded contoured shaped upstanding barriers for helping to hold back an avalanche of accumulated snow or ice, each barrier having a transverse dimension substantially less than the transverse dimension of said sheet;

said plurality of integrally formed upstanding barriers being arranged angularly displaced in spaced apart rows for helping to hold accumulated snow in its originally deposited position on said upper surface;

each integrally formed barrier having a smoothly rounded contoured back portion for facilitating the initial accumulation of snow thereabout curvilinearly, said back portion having a longitudinal dimension;

each integrally formed barrier further having an upstanding front wall portion for helping to arrest downward motion of accumulated snow along said upper surface;

said back portion being interconnected to said sheet of material along a curvilinearly shaped smoothly rounded bottom edge portion of said back portion;

said front wall portion being interconnected to said sheet of material along a straight bottom edge portion of said front wall portion;

said front wall extending upwardly from said upper surface at an angle $\theta$ relative thereto and terminating at a distance d sufficient to help reduce an avalanche of accumulated snow from moving along said upper surface;

said front wall having a smoothly rounded top edge extending traversely across the entire transverse dimension of the barrier for helping to prevent metal failures between the back portion and the front wall;

said back portion sloping downwardly and rearwardly from the smoothly rounded top edge of said wall to the upper surface along said back bottom edge portion for strengthening the body portion and the wall sufficiently to help prevent collapse when subjected to accumulated snow or ice loading;

said back body being generally triangularly shaped in cross section throughout the longitudinal dimension of each barrier for strengthening said body under accumulated snow or ice loading; and said front wall having a flat plane disposed at an angle $\beta$ other than zero relative to the transverse dimension to said sheet forming a lower corner and to guiding water flow downwardly under the force of gravity along said front wall and around said lower corner and downwardly away from said back portion for helping prevent the accumulation of standing water as accumulated snow or ice melts gradually.

2. A roofing panel according to claim 1, wherein said sheet further includes opposing longitudinal sides and an upstanding male seam member extending along substantially the entire longitudinal dimension on one side of said sheet and an upstanding female seam member extending along substantially the entire longitudinal dimension on the opposing longitudinal side of said sheet.

3. A roofing panel according to claim 1, wherein the angle $\theta$ is between about 86° and about 90°.

4. A roofing panel according to claim 1, wherein said sheet of metallic material is composed of a metallic material from the group consisting of galvanized steel, zinc-coated steel, aluminum, copper, tin, lead, zinc, lead-coated copper, micro zinc, and stainless steel.

5. A roofing panel according to claim 4, wherein said sheet of metallic material is coated with a corrosion resistent material.

6. A roofing panel according to claim 1, wherein each one of said spaced apart rows includes at least one pair of barriers; and wherein each barrier within said row is disposed at a substantially different angle $\beta$ from every barrier in every other of said rows.

7. A roofing panel according to claim 1, wherein the barriers in each of said rows are randomly disposed relative to one another.

8. A roofing panel according to claim 1, wherein angle $\beta$ is between about 15° and about 3°.

9. A roofing panel according to claim 8, wherein a more preferred angle $\beta$ is between about 15° and about 5°.

10. A roofing panel according to claim 9, wherein angle $\beta$ is between about 7° and about 2°.

11. A roofing panel according to claim 3, wherein a more preferred angle $\theta$ is between about 87° and about 89°.

12. A roofing panel according to claim 11, wherein the most preferred angle $\theta$ is about 88°.

13. A roofing panel according to claim 1, wherein the distance d is between about 0.03125 inches and about 4.000 inches.

14. A roofing panel according to claim 13, wherein a more preferred distance d is between about 0.0625 inches and about 2.00 inches.

15. A roofing panel according to claim 14, wherein the most preferred distance d is about 1.000 inch.

16. A roofing panel according to claim 1, wherein said rows are spaced apart by about 30 inches.

17. A roofing panel according to claim 1, wherein the transverse dimension of each barriers is between about 1 inch and about 24 inches.

* * * * *

UNITED STATES PATENT AND TRADEMARK OFFICE

CERTIFICATE OF CORRECTION

PATENT NO. : 5,205,088

DATED : April 27, 1993

INVENTOR(S) : George B. Mueller

It is certified that error appears in the above-identified patent and that said Letters Patent is hereby corrected as shown below:

Column 14, line 17, delete "barriers" and substitute therefor -- barrier --.

Signed and Sealed this

Seventeenth Day of May, 1994

Bruce Lehman

*Attest:*

BRUCE LEHMAN

*Attesting Officer*

*Commissioner of Patents and Trademarks*